US006516793B2

(12) United States Patent
Rice

(10) Patent No.: US 6,516,793 B2
(45) Date of Patent: Feb. 11, 2003

(54) LOW CARBON MONOXIDE GAS LOG ASSEMBLY

(75) Inventor: James S. Rice, Marshall, NC (US)

(73) Assignee: Appalachian Stove & Fabrications, Inc., Asheville, NC (US)

( * ) Notice: Subject to any disclaimer, the term of this patent is extended or adjusted under 35 U.S.C. 154(b) by 16 days.

(21) Appl. No.: 09/725,835

(22) Filed: Nov. 29, 2000

(65) Prior Publication Data

US 2002/0062827 A1 May 30, 2002

(51) Int. Cl.[7] ..... F24C 3/04
(52) U.S. Cl. ..... 126/512; 126/92 R; 431/125
(58) Field of Search ..... 126/512, 500, 126/92 R, 92 AC; 431/125, 328, 329

(56) References Cited

U.S. PATENT DOCUMENTS

| | | | | |
|---|---|---|---|---|
| 4,883,043 A | * 11/1989 | Thow et al. | ..... | 126/512 |
| 4,890,601 A | * 1/1990 | Potter | ..... | 126/512 |
| 4,940,407 A | * 7/1990 | Rehberg et al. | ..... | 126/512 |
| 5,000,162 A | 3/1991 | Shimek et al. | ..... | 126/512 |
| 5,069,200 A | * 12/1991 | Thow et al. | ..... | 431/125 |
| 5,320,520 A | 6/1994 | Barth et al. | ..... | 431/125 |
| 5,423,310 A | 6/1995 | Hudson et al. | ..... | 126/512 |
| 5,743,249 A | 4/1998 | Boekeloo et al. | ..... | 126/512 |
| 5,786,045 A | 7/1998 | Gerth et al. | ..... | 428/15 |
| 5,839,427 A | 11/1998 | Shorts | ..... | 126/512 |
| 5,890,485 A | 4/1999 | Shimek et al. | ..... | 126/512 |
| 5,988,159 A | 11/1999 | Blount | ..... | 126/512 |
| 6,006,742 A | 12/1999 | Jamieson et al. | ..... | 126/512 |
| 6,155,249 A | * 12/2000 | Gregory | ..... | 126/512 |

FOREIGN PATENT DOCUMENTS

| | | | | |
|---|---|---|---|---|
| GB | 0 156 968 A | * 10/1985 | ..... | 431/125 |
| GB | 2 215 033 A | * 9/1989 | ..... | 126/512 |

* cited by examiner

*Primary Examiner*—Henry Bennett
*Assistant Examiner*—Josiah C. Cooks
(74) *Attorney, Agent, or Firm*—Carter & Schnedler, P.A.

(57) ABSTRACT

There is provided a low carbon monoxide gas log assembly having a main gas burner and a neat gas burner. The main gas burner includes a plurality of exit ports. A batting containing rock wool is located above the exit ports and is not in contact with the exit ports. The batting is tilted at an angle greater than 0° but less than 90° with respect to the main gas burner. Heat from combustion at the exit ports causes portions of the batting to glow so that glowing embers are simulated while maintaining low carbon monoxide levels.

15 Claims, 3 Drawing Sheets

LOW CARBON MONOXIDE GAS LOG ASSEMBLY

BACKGROUND OF THE INVENTION

This invention relates to article log assemblies. More particularly, it relates to low carbon monoxide artificial log assemblies.

For centuries, homes have been heated with wood burning fireplaces. The aesthetics of wood burning fireplaces with its warm red glow of embers and the flicker of yellow flames is very appealing. However, building and maintaining a wood burning fire is time consuming, requires a substantial amount of maintenance and requires the purchase of properly seasoned wood. In addition, wood burning fireplaces create a substantial amount of ash which must be disposed of and require an expensive chimney flue which must be cleaned from time to time.

Gas burning fireplaces having artificial logs have been popular in order to avoid some of the problems associated with wood burning fire places. However, until recently, gas fired artificial logs have not been nearly as realistic and as aesthetically appealing as wood burning fireplaces.

In addition, until recently, gas fired artificial logs required a flue or vent, similar to a chimney required by a wood burning fireplace, in order to avoid deadly buildup of carbon monoxide in the room which is heated.

Oxygen depletion sensors, which automatically shut off the gas when oxygen is low, have enabled one to use a gas fired artificial log assembly in vent free applications, i.e. without the need for a flue vent or chimney. This innovation has greatly decreased the cost in the installation of gas fired artificial logs.

A typically gas fired artificial log assembly is described in U.S. Pat. No. 5,069,200. This patent shows a primarily burner in the front, a neat gas burner in the rear and a plurality of artificial logs. In order to add to the aesthetics, it is desirable that a gas fire artificial log assembly provide a means for simulating glowing embers. Often this is accomplish by piling loose rock wool on top of the main gas burner.

However, it has been found that since the gas must travel through the loose rock wool before combustion occurs, carbon monoxide levels are increased, resulting in safety and pollution hazards. Furthermore, since the rock wool is loose, the user of the gas log assembly can pile more and more rock wool on top of the primary burner, thereby making the carbon monoxide problem worse.

OBJECTS OF THE INVENTION

It is, therefore, one object of this invention to provide an improved carbon monoxide gas log assembly.

It is another object of this invention to provide a gas log assembly which provides realistic simulated glowing embers while maintaining low carbon monoxide levels.

It is a further object of this invention to provide a gas log assembly which reduces the likelihood that the user will cause increases in carbon monoxide levels.

SUMMARY OF THE INVENTION

In accordance with one form of this invention there is provided a low carbon monoxide gas log assembly, including a main gas burner having a plurality of gas exit ports. An amount of rock wool is provided, preferably in the form of batting. The batting is located above the exit ports and is not in contact with the exit ports. The exit ports are not in contact with solid material and are exposed to the oxygen in the air so that substantially unobstructed combustion will occur at the exit ports. Heat from combustion at the exit ports causes portions of the batting to glow so that glowing embers are simulated while maintaining low carbon monoxide levels.

In accordance with another form of this invention there is provided a low carbon monoxide gas log assembly. An elongated main gas burner is provided. The main gas burner has a plurality of exit ports. A glow material is provided. The glow material has a top surface. The top surface of the glow material is located above and juxtaposed to the exit ports. The surface is at an angle greater than 0° but less than 90° with respect to the main gas burner. Heat from combustion at the exit ports causes portions of the top surface of the glow material to glow. The ports are not in physical contact with the glow material so that glowing embers are simulated while maintaining low carbon monoxide levels.

BRIEF DESCRIPTION OF THE DRAWINGS

The subject matter which is regarded as the invention is set forth in the appended claims. The invention itself, however, together with further objects and advantages thereof may be better understood in reference to the following descriptions taken in conjunction with the accompanying drawings in which:

DESCRIPTION OF THE PREFERRED EMBODIMENT

Figure 1:
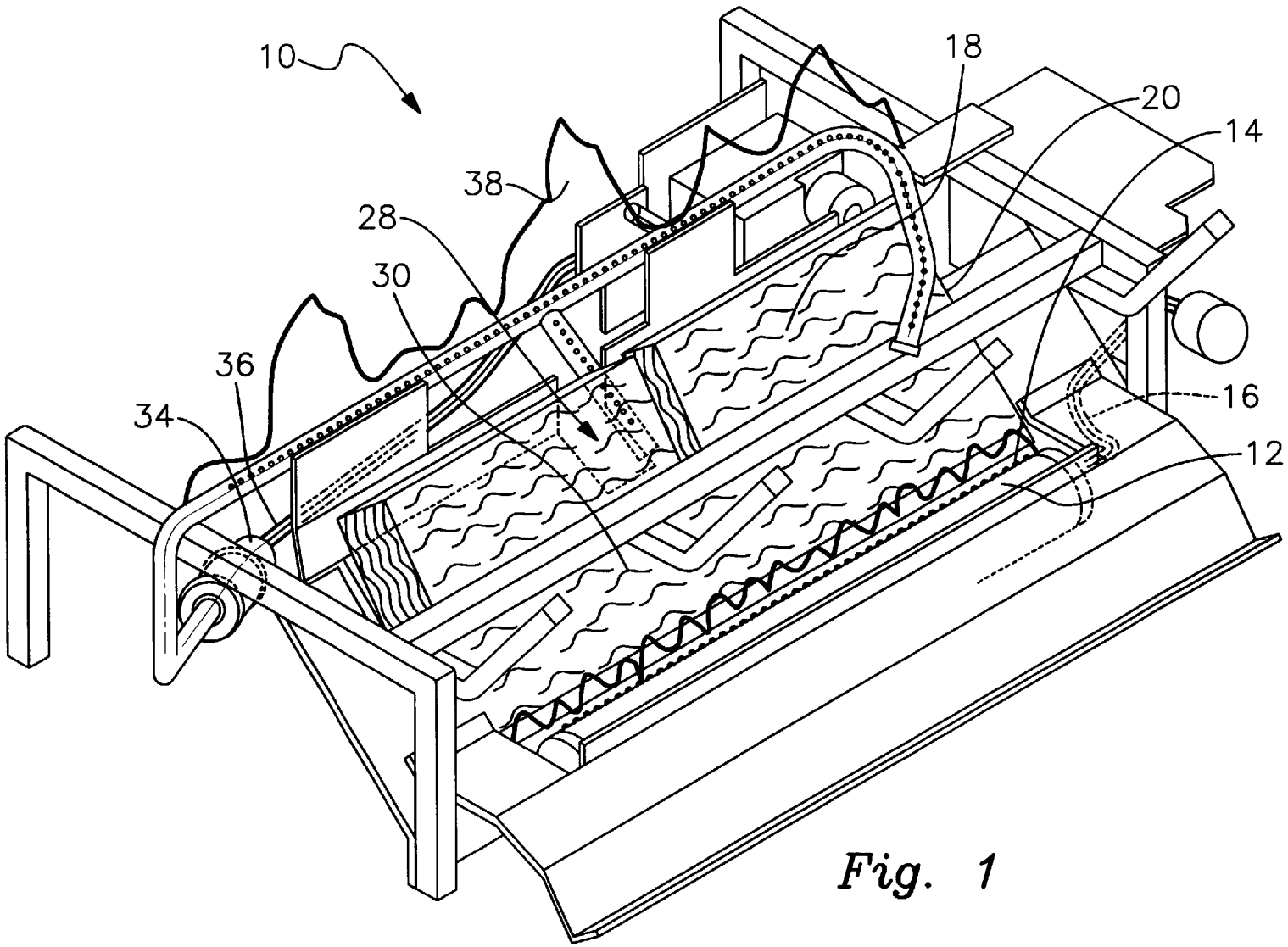
FIG. 1 is a perspective view of the low carbon monoxide artificial log assembly of the subject invention.
Figure 2:
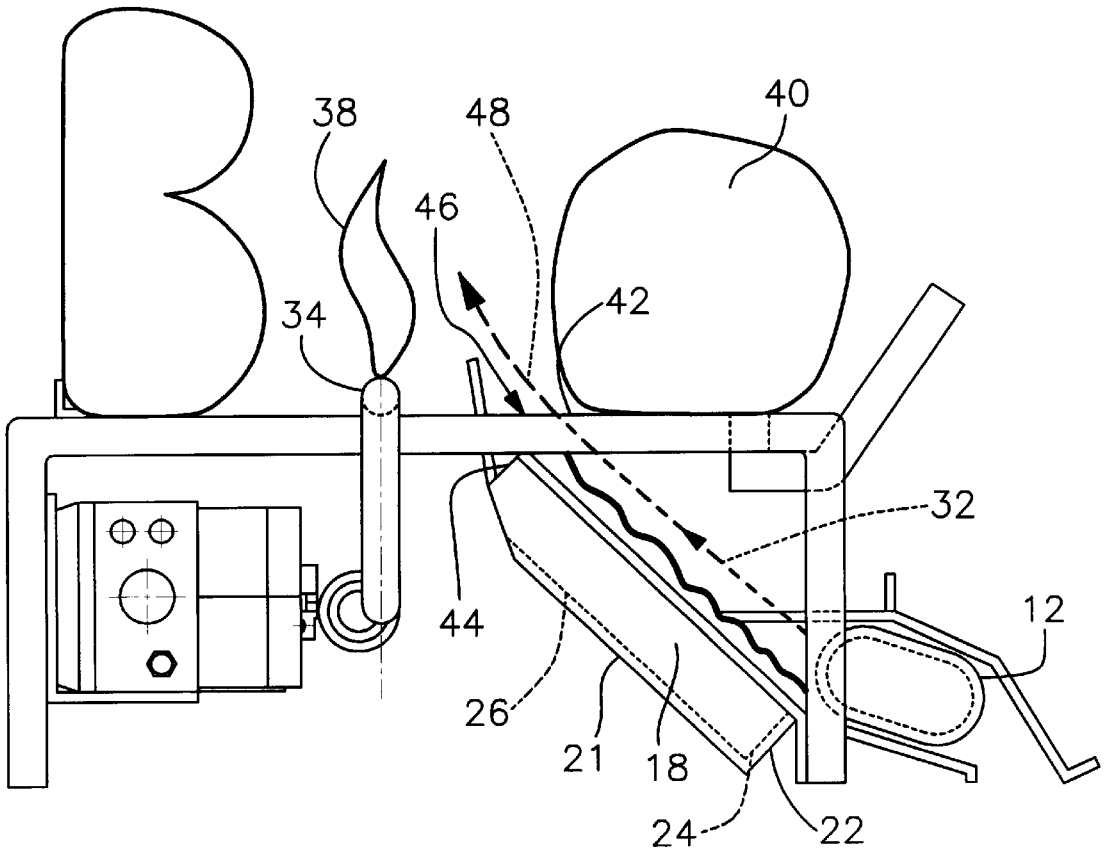
FIG. 2 is a side elevational view of the assembly of FIG. 1 with logs added.
Figure 3:
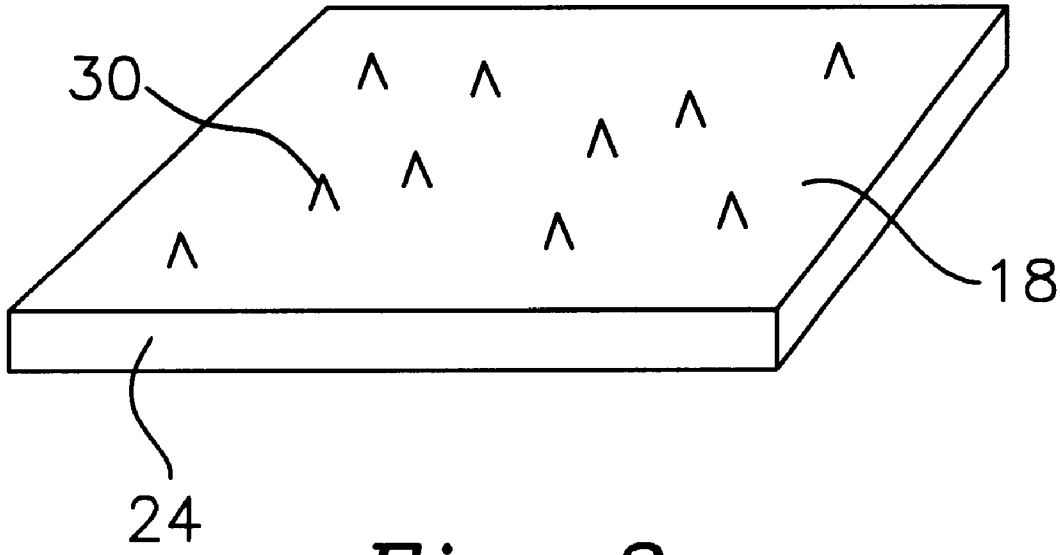
FIG. 3 is a perspective view of a batting of glow material used in FIG. 1.
Figure 4:
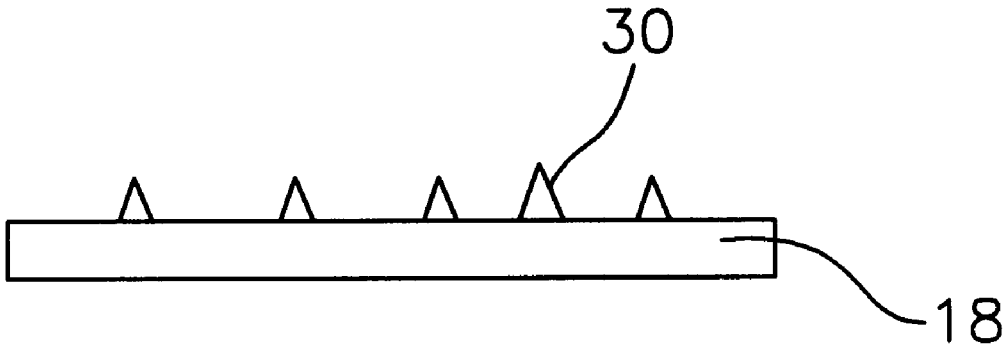
FIG. 4 is a side elevational view of the batting material shown in FIG. 3.

Referring now more particularly to FIG. 1, there is provided gas log assembly 10, having elongated main gas burner 12. Main gas burner 12 has a plurality of gas exit ports 14. Main gas burner 12 is connected to a source of flammable gas through tube 16 and a gas valve (not shown). The exit ports 14 are not in contact with any solid material. Thus, substantially complete combustion occurs at the exit ports, thereby resulting in low carbon monoxide levels.

Batting 18, which is made of a glow material which, preferably, is rock wool, is formed into a batting shape by adding glue to the rock wool and compressing the rock wool. Batting 18 is received in tray 20. Alternatively, loose rock wool could be placed in tray 20 instead of batting 18.

As can be seen in FIG. 1, tray 20 includes front lip 22 upon which front edge 24 of batting 18 rests. The bottom surface 26 of batting 18 rests on the base 21 of tray 20. Base 21 of tray 20 is oriented at an angle greater than 0° and less than 90° with respect to the longitudinal axis of elongated main gas burner 12. Thus the batting 18 is also oriented at an angle greater than 0° and less than 90° with respect to the longitudinal axis of elongated main gas burner 12.

Top surface 28 of batting 18 is roughened, as illustrated by the plurality of peaks 30. This causes some of the rock wool on the top surface 28 to become loosened, however, the loosened rock wool remain adhered to the batting 18. Roughening of the top surface 28 of batting 18 may be accomplished by scraping the top surface with a sharp object. Preferably, batting 18 is oriented at an angle approximately 45° with respect to the longitudinal axis of main gas burner 12. By having batting 18 juxtaposed and above the main gas burner 12 and with batting 18 oriented at an angle with respect to the main gas burner 12, heat from combustion at ports 14 will travel along the top surface 28 of batting 18 and will cause the rock wool on the top surface 28 to glow, in particularly, at the peaks 30. The movement of the heat from the exit ports 14 is illustrated by arrows 32.

The gas log assembly 10 also includes neat gas burner 34 which is located behind and above batting 18. Neat gas burner 34 is connected to a source of combustible gas through tube 36. The gas from the neat gas burner 34 is mixed with very little oxygen, thereby resulting in flickering yellow flames 38, which adds realism to the gas log assembly.

Gas log assembly 10 also includes a gas log 40 supported by support member 42. Batting 18 includes upper edge 44. The positioning of log 40 is juxtaposed but spaced from upper edge 44 of batting 18, thereby providing narrow gap 46. This narrow gap 46 causes a chimney affect to occur with respect to the heat 32 moving along the top surface 28 of batting 18. This results in an increase velocity of heated air through gap 46, as illustrated by arrow 48. This increase in velocity of the heated air will result in the flame 38 from neat gas burner 34 to dance, thereby, further enhancing the realism.

Furthermore, by the position of log 40 will hide the upper edge 44 of batting 18 from the view of a person located in front of the gas log assembly 10. This feature further adds to the realism of the gas long assembly 10.

Thus log 40 provides a three-fold function, all of which add to the realism of the gas log assembly, namely, provides the appearance of a natural log, hides the upper edge 44 of batting 18 and causes flame 38 to dance due to the chimney affect. A gas log assembly is thereby provided having enhanced realism, including simulated glowing embers, while maintaining low carbon monoxide levels.

From the foregoing description of the preferred embodiment of the invention, it will be apparent that many modifications may be made therein. It should be understood, however, that this embodiment of the invention is an exemplification of the invention only and that the invention is not limited thereto. It is to be understood, therefore, that it is intended in the appended claims to cover all modifications as fall within the true spirit and scope of the invention.

What is claimed is:

1. A low carbon monoxide gas log assembly comprising:

a main gas burner; said main gas burner having a plurality of gas exit ports;

an amount of rock wool; said rock wool located above said exit ports and not being in contact with said exit ports; said exit ports are not in contact with solid material and are exposed to the oxygen in the air, wherein substantially unobstructed combustion will occur at said exit ports;

heat from combustion at said exit ports causes portions of said rock wool to glow, whereby glowing embers are simulated while maintaining low carbon monoxide levels; said rock wool is in the form of a batting; said batting having a top surface; said top surface exposed to the heat from said exit ports; said top surface being roughened, wherein the glow is enhanced; said roughened top surface of said batting includes an amount of rock wool loosened from said batting but remaining adhered to said batting and forming a plurality of peaks projecting from said top surface; said main gas burner is in the form of an elongated horizontal tube; said batting being at an angle greater than 0° but less than 90° with respect to the longitudinal axis of said main gas burner.

2. A gas log assembly as set forth in claim 1, further including a tray; said tray having a front lip; said tray supporting said batting.

3. A gas log assembly as set forth in claim 2, wherein said batting having an upper ledge and a lower edge; said lower edge of said batting is supported by said front lip of said tray.

4. A gas log assembly as set forth in claim 1, further including an elongated simulated log; said log positioned in front of said upper edge of said batting forming a gap between said upper edge and said log providing a chimney affect for the heat rising from said exit ports of said main gas burner and hiding the upper edge of said batting from view.

5. A gas log assembly as set forth in claim 4, further including a neat gas burner; said neat gas burner located behind said log; the flame from said neat gas burner being caused to dance due to the chimney affect from the rising heat from said main gas burner through said gap between said log and said batting.

6. A gas log assembly as set forth in claim 1, wherein said angle is approximately 45°.

7. A gas log assembly as set forth in claim 1, wherein said rock wool batting contains glue to hold the rock wool together.

8. A low carbon monoxide gas log assembly comprising:

an elongated horizontal main gas burner; said main gas burner having a plurality of gas exit ports;

a glow material; said glow material having top surface; said top surface of said glow material located above and juxtaposed to said exit ports; said top surface of said glow material being at angle greater than 0° but less than 90° from the longitudinal axis of said main gas burner; heat from combustion at said exit ports causing portions of the glow material to glow; said exit ports not being in physical contact with said glow material, whereby glowing embers are simulated while maintaining low carbon monoxide levels; said glow material is rock wool having been shaped in the form of a batting; said batting has a top surface; said top surface exposed to the heat from said exit port; said top surface being roughened, wherein the glow is enhanced; said roughened top surface of said batting includes an amount of rock wool loosened from said batting but remaining adherent to said batting and forming a plurally of peaks projecting from said top surface.

9. A gas log assembly as set forth in claim 8, wherein said batting has an upper edge and a lower edge.

10. A gas log assembly as set forth in claim 9, further including a tray; said tray supporting said batting.

11. A gas log assembly as set forth in claim 10, wherein said tray has a front lip; said lower edge of said batting is supported by said lip of said tray.

12. A gas log assembly as set forth in claim 11, further including an elongated simulated log; said log positioned in front of said upper edge of said batting so as to hide the upper edge of said batting from vision and to provide a chimney affect for the heat raising from said exit ports of said main gas burner.

13. A gas log assembly as set forth in claim 12, further including a neat gas burner; said neat gas burner located behind said log; the flame from said neat gas burner being caused to dance due to the chimney affect from the rising heat from said main gas burner between said log and said top surface of said batting.

14. A gas log assembly as set forth in claim 13, wherein said angle is approximately 45°.

15. A gas log assembly as set forth in claim 14, wherein said batting contains glue to hold the rock wool together.

* * * * *